United States Patent [19]

Lewis

[11] 4,061,397

[45] Dec. 6, 1977

[54] DRIVE MECHANISM FOR RECLINING CHAIRS

[76] Inventor: Michael Roland Lewis, 72 Pole Hill Road, Uxbridge, Middlesex, England

[21] Appl. No.: 665,145

[22] Filed: Mar. 8, 1976

[30] Foreign Application Priority Data

Mar. 11, 1975 United Kingdom ..... 9998/75

[51] Int. Cl.[2] ..... A47C 1/02

[52] U.S. Cl. ..... 297/330; 297/68

[58] Field of Search ..... 297/330, 68, 85, 88, 297/86; 5/109

[56] References Cited

U.S. PATENT DOCUMENTS

| | | | |
|---|---|---|---|
| 2,714,922 | 8/1955 | McKibbon | 297/330 |
| 2,845,635 | 8/1958 | Eyer | 5/109 |
| 3,147,038 | 9/1964 | Barabas | 297/330 X |
| 3,381,990 | 5/1968 | Fritz et al. | 297/330 X |
| 3,588,170 | 6/1971 | Knabusch | 297/330 X |
| 3,641,995 | 2/1972 | Brandt | 297/330 X |
| 3,719,391 | 3/1973 | Neri | 297/330 |

*Primary Examiner*—James T. McCall
*Attorney, Agent, or Firm*—Seidel, Gonda & Goldhammer

[57] ABSTRACT

The drive mechanism complements the existing mechanical linkage in a conventional reclining chair, and comprises an electric motor which operates through a series of levers to enable the normal movement of the chair between its upright and reclined positions to be powered. The mechanism is designed to follow the locus of movement of the existing mechanical linkage, thus rendering unnecessary any modifications to the linkage.

8 Claims, 8 Drawing Figures

DRIVE MECHANISM FOR RECLINING CHAIRS

The present invention relates to a drive mechanism for reclining chairs. Although particularly designed for use with chairs, the drive mechanism of this invention also finds use in similar articles, such as sofas or couches.

A diagrammatic side view of a known type of reclining chair is shown in FIG. 1 of the accompanying drawings, to which reference will now be made. The chair comprises a frame having a base 1 on which are mounted castors 2 for enabling the chair to be moved. The base 1 supports a squab 3, seat 4 and leg/foot rest 5 which are all conventional and will not be described further. The seat 4 is supported on the base by means of a mechanical linkage (not shown) which connects to a bracket, shown diagrammatically under reference 6, attached to the seat and extending downwardly therefrom. The mechanical linkage is such as to allow the seat to move so that the locus of a point P on the bracket 6 is a cusp shape, as shown by the dotted line 7. The seat 4 is also mechanically linked with the squab 3 and leg/-foot rest 5 so that movement of any one of these causes movement of all three. Thus, in this way, the elements 3, 4 and 5 can be manipulated between an upright position, as shown in FIG. 1, and a reclined position in which the squab 3 is tilted backwards and the leg/foot rest 5 is tilted upwards substantially onto the same plane as the seat 4. The locus line 7 describes the position of the seat as it moves between the upright and reclined positions, and it will be seen that, in the reclined position, the seat 4 is tilted back slightly and raised.

Movement of the elements of the chair between the two extreme positions (as well as any desired position inbetween) has hitherto been effected manually, either by means of a lever at the side of the chair, or by the user shifting his body weight and thus actuating the mechanical linkages by alteration of the centre of gravity of his body.

Although manual actuation of the linkage is satisfactory in many cases, there are situations in which such actuation is difficult or impossible. For example if space is restricted, or if it is necessary for the user to concentrate on other items, such as driving a car, difficulties may be experienced in adjusting the chair. In addition elderly or disabled people often do not have the strength or ability to successfully adjust the chair.

The present invention seeks to provide a drive mechanism for reclining chairs of the type shown in FIG. 1 which enables a user to adjust the chair merely be actuating a switch.

In accordance with the invention, there is provided a drive mechanism for a reclining chair or the like, said mechanism comprising an electric motor for mounting on the frame of the chair; manually operable switch means for selectively supplying electric power to the motor; a crank lever provided on a shaft driven by the electric motor; a bracket for attachment to the seat of the chair; and a link member, one end of which is pivotally connected to the crank lever such that the locus of movement of the pivot point is circular, and the other end of which is pivotally connected to the bracket.

Although it is preferred that the electric motor be attached to the frame of the chair and the bracket to the seat, it is clear that the inverse arrangement, i.e. with the electric motor attached to the seat and the bracket to the chair frame, could also be used. It is intended that the present invention should cover such an alternative arrangement.

The drive mechanism of the invention complements, rather than replaces, the existing mechanical linkage of the chair. Indeed, the mechanical linkage must be retained in order to provide support for the squab, seat and leg/foot rests as well as to ensure that relative movement between the parts is correct.

In order to avoid running the electric motor at a very low speed, it is preferable to provide a step down gearbox between the motor and the shaft carrying the crank. Preferably also, the drive from the motor to the shaft is non-reversable — i.e. drive may be transmitted from the motor to the shaft, but not from the shaft to the motor. This allows the mechanism to be halted at any intermediate position between the upright and reclined positions, and prevents movement of the elements of the chair when they are stopped in any position. On the other hand, the drive itself can be reversed in order to allow movement of the elements of the seat in both directions - i.e. from upright to reclined and vice versa. For this purpose, the switch means may comprise a two-way rocker switch with a centre off position. Alternatively, the switch means may comprise three push buttons — one for each direction of movement, and the third for the off or halt function.

It is desirable that the inertia of the drive mechanism is as low as possible in order to ensure that the drive halts as quickly as possible after the electric power to the motor has been cut off. If this is not the case, it is difficult for a user to judge when to operate the switch means in order to cause the elements of the chair to take up the particular position desired.

The mechanical linkages which support the seat, and interconnect the seat, squab and leg/foot rests normally themselves limit movement beyond the terminal positions — i.e. fully upright and fully reclined — and it is therefore possible to allow the mechanism to run into either of the terminal positions without removing the power from the motor. The motor would thus stall and come to a halt with power still applied. Although motors are available which allow power to be safely applied even when they are stalled, it is preferred to provide means whereby the power to the electric motor is cut off as the terminal positions are reached. Preferably this is achieved by one or more microswitches which are actuated by the crank lever as it rotates. Such microswitches may be arranged to be actuated just before the terminal positions in order to allow for continued movement of the mechanism due to inertia. In addition, it is desirable to use a motor with a low torque in order to prevent damage to the drive mechanism or mechanical linkages should the microswitch or microswitches fail for any reason. It is also desirable to provide the motor with a thermal cut-out for the same reason. The use of microswitches results in a number of advantages as follows:

1. the possibility of fatiguing the limit stops of the existing linkage, and of other parts of the drive mechanism and gearing is prevented;

2. it is easy to provide reversing switch functions when automatic cycling is required (see later);

3. the possibility of using a smaller, cheaper motor, not capable of continuous stall; and 4. user confidence is increased — the sound of a motor being forced to a halt is not pleasing.

The circular locus described by the pivot point between the crank lever and the link does not allow the pivot point between the link member and the bracket to move perfectly over the cusp shaped locus dictated by the properties of the mechanical linkage which supports the seat. This being the case, it has been found desirable, in order to avoid undue strain on the drive mechanism at certain stages of its movement, to deliberately introduce a measure of elasticity or play, into the system. Such elasticity may be introduced in a number of ways, for example by providing an elastic mounting for the electric motor on the frame of the chair or by providing an extensible link member or a compressible crank lever. Alternatively, the arrangement may be such that the pivot between the crank lever and the link members is by way of a pin on one of these members which is slidable in a slot in the other, thus resulting in a degree of play in the pivotal connection between the link member and crank lever. However, the introduction of play into the mechanism can result in noise which can be disturbing to a user. It is thus preferred to employ elasticity, rather than play, and in a preferred embodiment of the invention, such elasticity is provided for in the attachment of the bracket to the seat of the chair.

In order that the invention may be better understood, an embodiment thereof will now be described by way of example only and with reference to the accompanying drawings in which.

Figure 1:
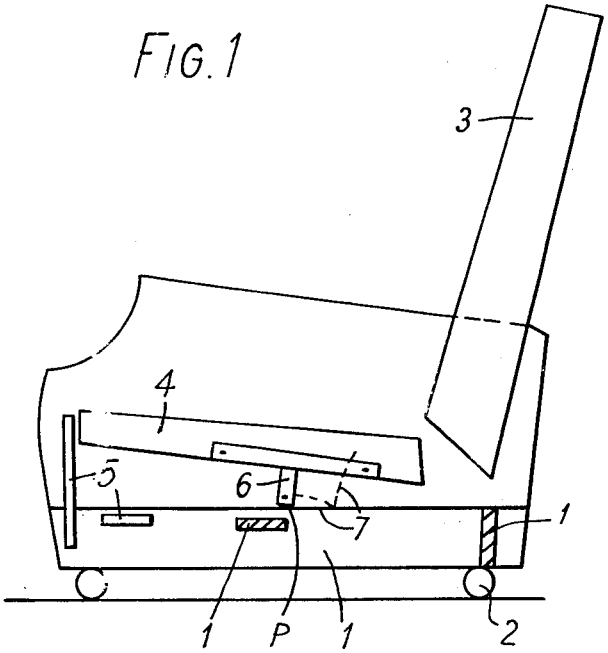
FIG. 1 is a diagramatic side view of a known type of reclining chair.

The reference numerals used in FIG. 1 have been included, where appropriate, in FIGS. 2 to 8. Referring now to FIGS. 2 to 8, the drive mechanism comprises a capacitor start and run motor 8 the output of which drives a step down gearbox 9. The gearbox 9 comprises a series of worm and pinion reduction gears, giving a total reduction ratio of typically 1450 : 4. The use of worm and pinion gearing ensures that drive is transmitted through the gearbox to its output shaft, but not in the opposite direction. The output shaft of the gearbox, which typically rotates under power at 4 r.p.m., has a crank lever 10 attached thereto. The crank lever 10 is itself pivotally connected to a rigid link member 11 and the link member 11 is pivotally attached to the bracket 6 attached to the seat 4 of the chair. It is possible that the bracket 6 may already be provided on the chair, as shown in FIG. 1, as part of the linkage mechanism (not shown in FIGS. 2 to 4). However, even if it is already provided, it may be preferable to mount a bracket 6 especially for the drive mechanism of the present invention, since it is desirable that the bracket 6 be fixed to the frame of the seat 4 in a particular manner, as will be explained hereinafter.

Figure 2:
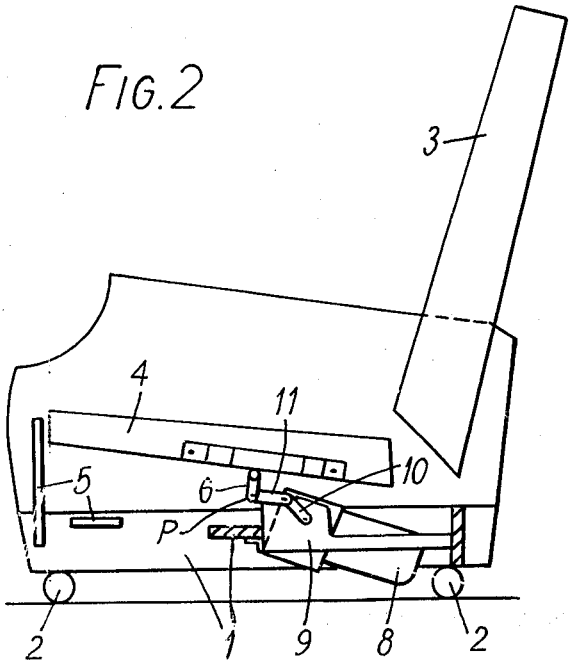
FIGS. 2, 3 and 4 are diagrammatic side views of a reclining chair having a drive mechanism according to the present invention, showing respectively the fully upright, intermediate, and fully reclined positions.
Figure 3:
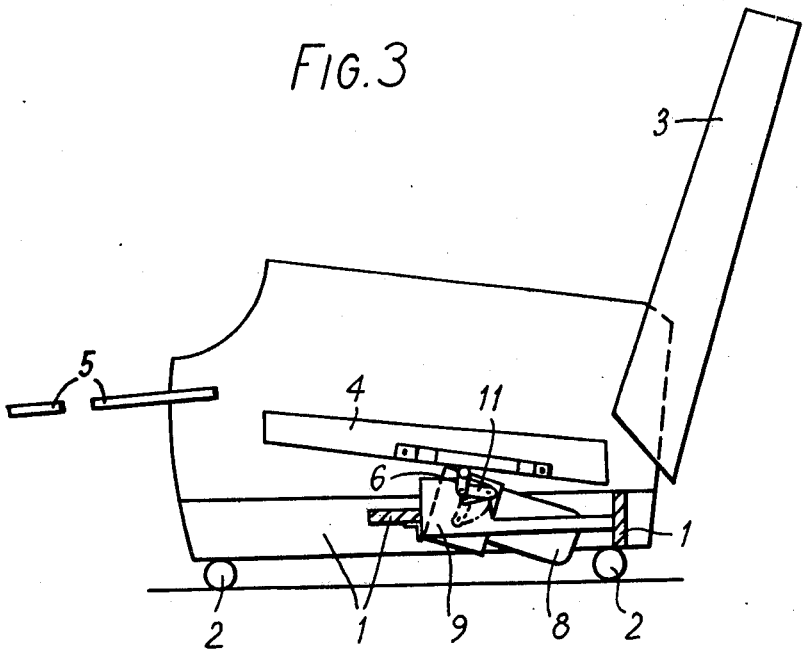

The sequence of operation will now be explained with particular reference to FIGS. 2 to 4: FIG. 2 shows the chair in its fully upright position, and shows the relative positions of the various elements in the drive mechanism in that position. In the fully upright position of the chair, the crank lever 10 is in its extreme anticlockwise position. Further anticlockwise rotation of the lever 10 is prevented by the constraints of the mechanical linkage which supports the seat 4. Clockwise rotation of the crank lever 10 pulls the link member 11 and bracket 6 around a circular arc until the position shown in FIG. 3 is reached. During this motion, the point P, corresponding to the pivot point between the link member 11 and the bracket 6, describes the left hand part of the locus 7 illustrated in FIG. 1. From this position further clockwise rotation of the crank lever 10 causes substantially no movement of the point P, and hence bracket 6. In fact, the crank lever 10 rotates right around to the position shown in dotted lines in FIG. 3 before any further significant movement of the point P takes place.

Figure 4:
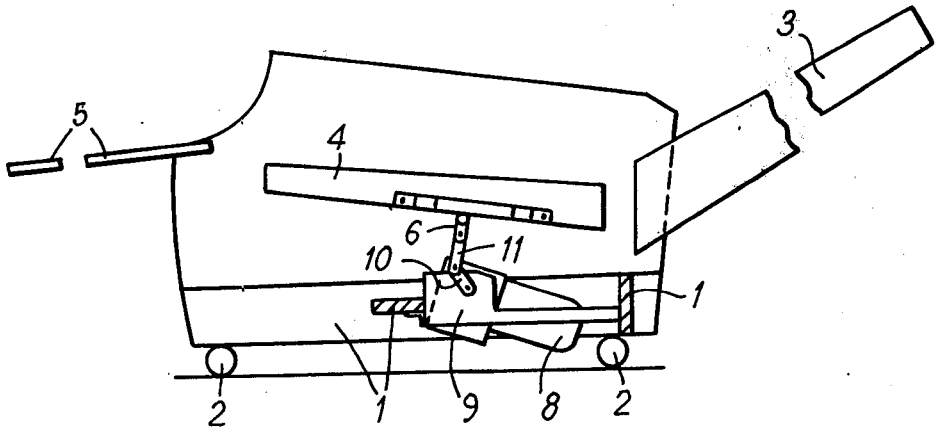

As the crank lever 10 continues its clockwise rotation beyond the dotted line position shown in FIG. 3, the point P starts to rise upwards, describing the second part of the cusp shaped locus illustrated in FIG. 1, until it eventually reaches the position shown in FIG. 4. FIG. 4 shows the chair in its fully reclined position, and with the crank 10 in its extreme clockwise position. Further movement of the crank lever 10 beyond this position is prevented by the constraints exhibited by the mechanical linkage which supports the seat 4.

The seat can be returned to its fully upright position (or to any intermediate position) by reversing the direction of rotation of the motor 8, whereupon the above sequence is reversed.

In the above, it must be remembered that the seat 4, and hence bracket 6, is constrained by the mechanical linkage to move along the locus 7. The above described drive mechanism merely powers the movement around the locus.

Figure 5:
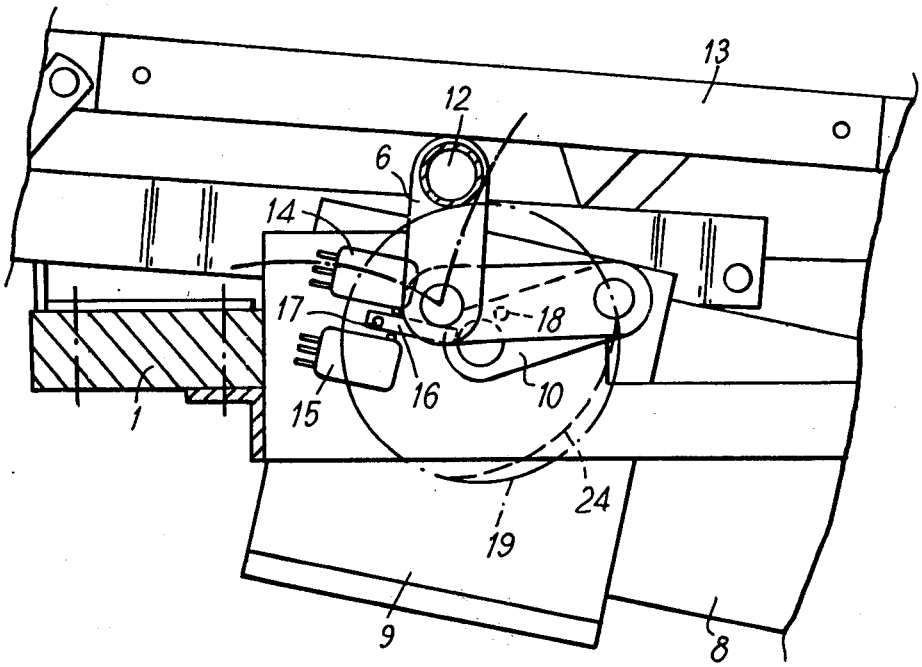
FIG. 5 is an enlarged side view of part of the drive mechanism shown in FIGS. 2, 3 and 4.
Figure 6:
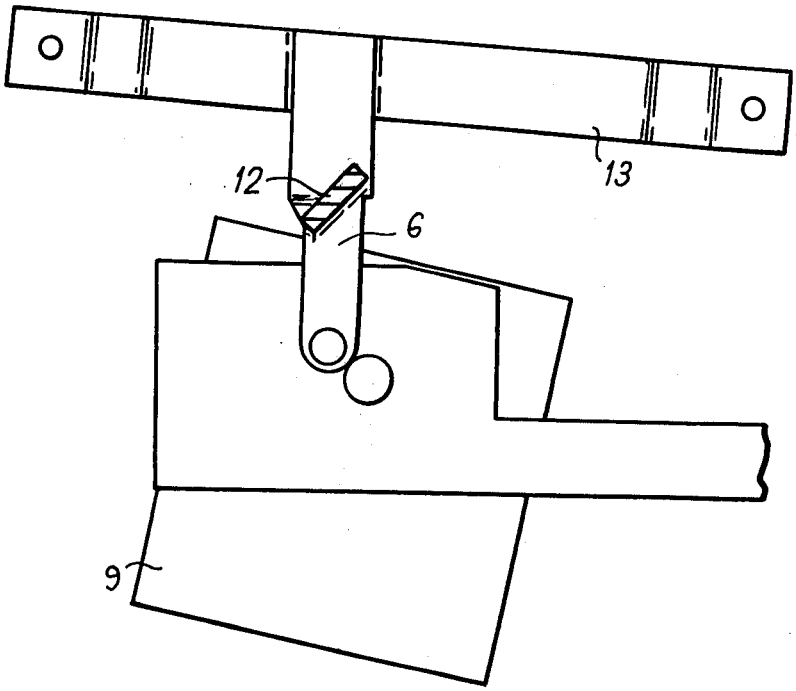
FIG. 6 is a view of part of FIG. 5 showing an alternative form of cross piece.
Figure 7:
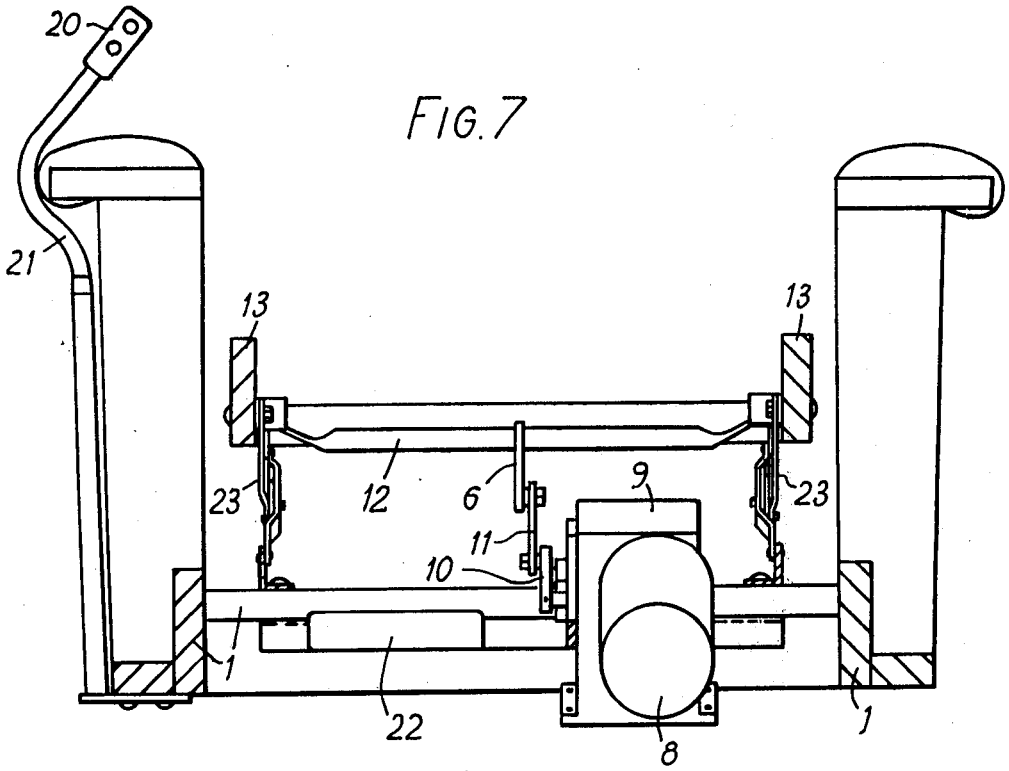
FIG. 7 is a rear view of the chair of FIGS. 2, 3 and 4, with the squab and certain other parts removed for clarity.
Figure 8:
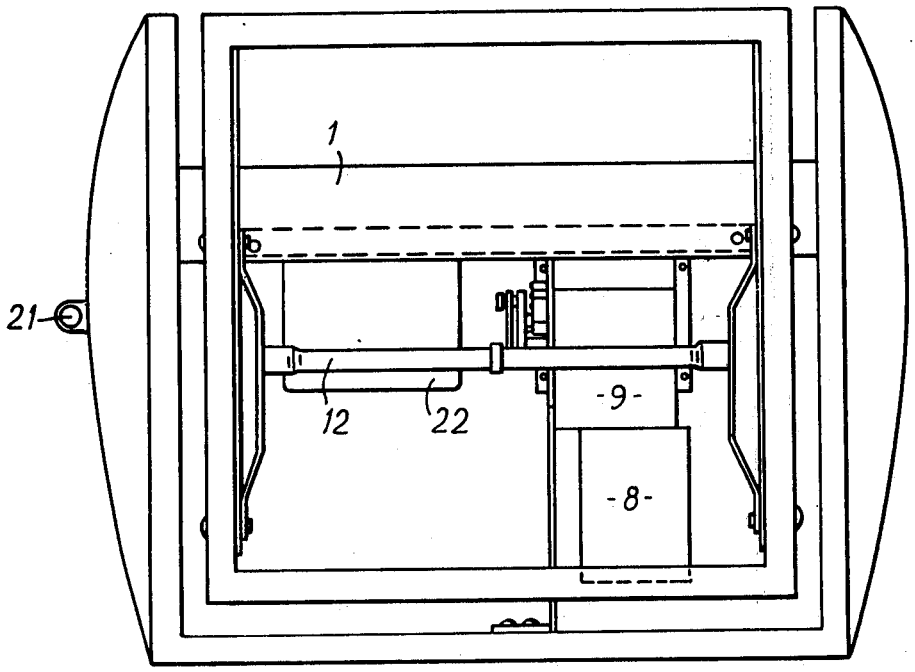
FIG. 8 is a plan view of the seat of FIG. 7 with several parts removed for clarity.

FIGS. 5, 6, 7 and 8 show the mechanism in greater detail, and particular reference is now directed to these Figures. FIG. 5 shows an enlarged detail of the drive mechanism, in the FIG. 3 position, and clearly shows the arrangement of the crank lever 10, link member 11 and bracket 6. As the crank lever rotates clockwise beyond the position shown, the point P tends to be pulled in a downwards direction away from the line of the locus 7. This can cause severe strain on the mechanism, and is provided for in the present design by elastically mounting the bracket 6 to the frame of the seat 4 in a manner which permits the bracket to move downwards relative to the seat. This is achieved by fixedly mounting the bracket, for example by welding, to the central part of a cross piece 12 whose ends are fixed to respective sides of the frame 13 of the seat 4 (the cushion of the seat 4 is omitted in FIGS. 5, 6, 7 and 8 for clarity). The cross piece 12 may take the form of a tube, as shown in FIGS. 5, 7 and 8, whose ends are flattened for fixing to the sides of the frame 13 of the seat 4. Alternatively the cross piece 12 may take the form of an elongate strip, as shown in FIG. 6, which is angled in such a direction that its general plane is at right angles to the line joining the centre of the width of the strip, and the point on the line 19 which is at the maximum distance from the line 24. Thus the strip is able to provide its maximum elasticity (which is at right angles to its general plane) at the point where the maximum deflection is required. In both cases, the elasticity exhibited by the cross piece 12 in its central part permits the small degree of downwards movement of bracket 6 which is necessary to prevent strain in the mechanism.

In order to ensure correct functioning of the mechanism, it is important that the geometry of the crank lever, link member and bracket is carefully calculated to ensure that the correct thrust is applied at the correct time. In the first place, and as will be clear from FIG. 5, the link member 11 is significantly longer than the crank lever 10. In one particular example, the distance between the link member pivot points is 2.3 inches while the distance between the crank lever pivot point and the axis of the gearbox output shaft is 1.9 inches. If the difference in length is too small there is a danger that, owing to friction and tolerances in the various parts of the system, the mechanism will not provide thrust in the appropriate direction.

It has also been found that the angular distance over which the crank lever 10 travels during which substantially no movement of the point P takes place (i.e. between the full line and dotted line positions of FIG. 3) should be fairly large, typically 120°, for satisfactory operation. If the angle is smaller, there is a danger that the dotted line position of the crank lever results in the link member being inclined to the left at the moment that it starts to apply upward thrust to the bracket 6, with the consequent danger of the mechanism merely retracing its steps along the horizontal portion of the locus 7, rather than continuing upwardly along the vertical portion of the locus.

The dotted line 19 on FIG. 5 shows the locus of movement of the pivot point between the crank lever 10 and link member 11. The dotted line 24 on FIG. 5 shows the arc which the other end of the link member would follow if it were not connected to the crank lever. The built-in elasticity permits the link member to follow the line 19 with the crank lever. Clearly, the elastic displacement required is equal to the maximum distance between the two lines 19 and 24.

A pair of microswitches 14, 15 are provided for cutting off the electrical power to the motor at the extreme positions of movement of the crank lever 10. The microswitches are actuated by a trip lever 16, pivotted relative to frame 1 at point 17. A peg 18 is provided on the crank lever 10, which peg is positioned so as to hit the lever 16 which in turn actuates the appropriate microswitch 14, or 15, depending upon the extreme position reached.

FIGS. 7 and 8 show the position of the drive mechanism relative to the remainder of the chair. It will be seen that the components of the drive mechanism are positioned centrally beneath the seat, so that their weight does not adversely affect the centre of gravity of the chair. An occupant of the chair is able to control the mechanism by means of a two push-button switch 20 which is mounted on a flexible metal tube support 21. The support 21 is attached at its lower end to the frame of the chair. The two push-buttons are spring loaded types, one for each direction of movement. If neither push-button is depressed current to the motor is cut off.

For safety purposes, and in order to avoid the need for bulky heavy duty push-button switches, it is desirable to control the current supply to the electric motor 9 by means of relays, themselves by the push-button switch 20. The microswitches 14 and 15 may control relays in a similar manner. For this purpose a container 22 is mounted on the chair frame underneath the seat, which container houses the relays, as well as other auxilliary items such as transformers, fuses, and the motor capacitor. The use of a switch to control a relay handling a heavy current supply is conventional, and will not be described.

FIG. 7 also shows part of the mechanical linkage which supports the seat 4 and controls the movement of the seat. This is shown under reference 23, but will not be described in detail since it is known.

There has been described a drive mechanism for a reclining chair which enables a user to easily move the chair from an upright to a reclined position and vice versa whilst sitting in the chair. A further use for such a mechanism is in reclining chairs used for display purposes in showrooms, where the switches can be set to provide continuous motion of the chair between its extreme positions. A potential purchaser of the chair can thus view the movement of the chair without the major part of the chair being obscured by a person seated in it. In this case, the flexible support 21 and switch 20 may be dispensed with and additional circuitry is provided within the container 22 to achieve the automatic cycling.

I claim:

1. A drive mechanism for a reclining chair or the like comprising:

an electric motor mounted on a chair frame;

manually operable switch means for selectively supplying electric power to said motor;

a shaft driven by said motor;

a crank lever attached to said shaft;

a bracket;

flexible means for attaching said bracket to a seat of the chair;

said flexible means comprising an elongate member extending transversely across the underside of the seat;

said elongate member having its ends attached to the seat;

a portion of said bracket being fixedly attached to a central part of said elongate member;

a link member having one end pivotally connected to said crank lever such that the locus of movement of the pivot point is circular and having its other end pivotally connected to another portion of said bracket;

said bracket and said elongate member being movable in both a horizontal and a vertical direction, whereby said seat is movable over a substantially horizontal first arc and a substantially vertical second arc.

2. A drive mechanism as claimed in claim 1 further comprising a step down gearbox between the motor and the shaft carrying the crank.

3. A drive mechanism as claimed in claim 2 wherein the drive through the gearbox is non reversable, allowing drive from the electric motor to the shaft but not from the shaft to the motor.

4. A drive mechanism as claimed in claim 1 further including switch means for automatically cutting off the power to the electric motor at or near each of two terminal positions of movement of the seat of the chair.

5. A drive mechanism as claimed in claim 4 wherein the automatic switch means comprises a pair of microswitches operable to cut off the power to the electric motor, and engagement means for actuating a respective one of said microswitches at or near each terminal position.

6. A drive mechanism as claimed in claim 5 wherein said engagement means comprises a pivoted lever which is positioned between the two microswitch operating buttons and a peg mounted on said crank lever which is engageable with said pivoted lever to thereby pivot the lever in one direction or the other according to the direction of rotation of the crank lever, and thus actuate a respective one of said microswitches.

7. A drive mechanism as claimed in claim 1 wherein the elongate member takes the form of a tube.

8. A drive mechanism as claimed in claim 1 wherein the elongate member takes the form of a strip.

* * * * *